United States Patent [19]

Gilbert

[11] 4,074,780

[45] Feb. 21, 1978

[54] EARTH AUGER

[76] Inventor: Robert E. Gilbert, 166 High St., Buffalo, Wyo. 82834

[21] Appl. No.: 709,293

[22] Filed: July 28, 1976

[51] Int. Cl.[2] ..... E21C 1/14; E02D 7/14; E21B 9/06

[52] U.S. Cl. ..... 175/392; 175/323; 175/394; 175/398; 175/421

[58] Field of Search ..... 179/323, 394, 395; 298/87; 175/392, 421, 398, 386

[56] References Cited

U.S. PATENT DOCUMENTS

| | | | |
|---|---|---|---|
| 1,116,154 | 11/1914 | Stowers | 175/323 |
| 2,680,597 | 6/1954 | Brown | 175/394 X |
| 2,863,640 | 12/1958 | Peterson | 175/394 X |
| 3,240,513 | 3/1966 | Turzillo | 175/323 UX |
| 3,864,923 | 2/1975 | Turzillo | 175/394 X |

*Primary Examiner*—Ernest R. Purser
*Assistant Examiner*—William F. Pate, III
*Attorney, Agent, or Firm*—Victor J. Evans & Co.

[57] ABSTRACT

An earth auger having an integral or one piece cutting blade and pilot element so arranged that the pilot element is spaced downwardly from the shaft of the auger; the cutting blade also having a curved edge swept back from the axis of the auger to provide a slicing action as well as "threading" action to facilitate penetration of the auger into the ground.

3 Claims, 4 Drawing Figures

FIG. 1.
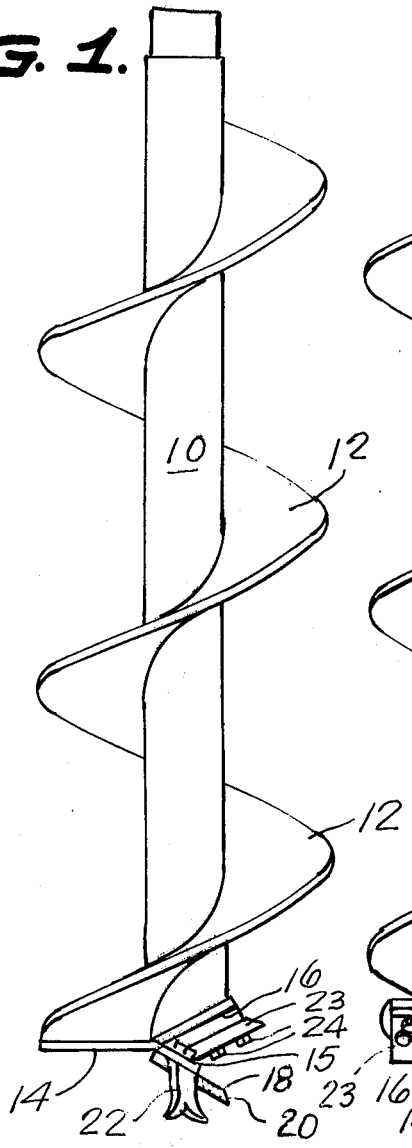
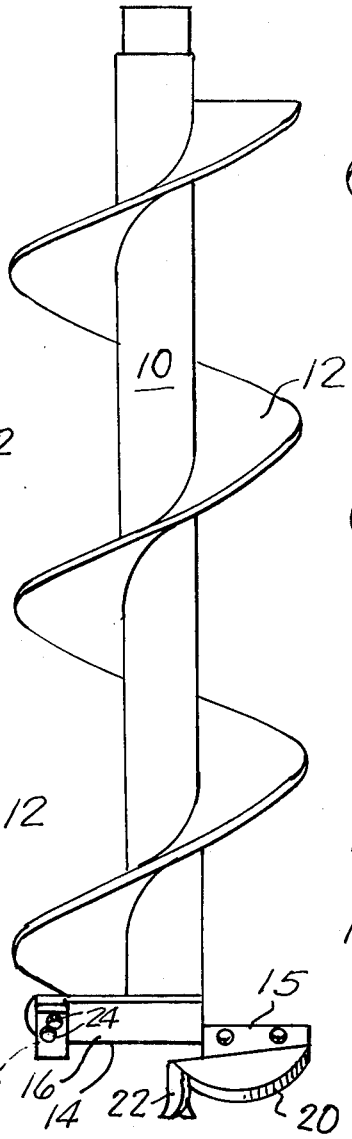
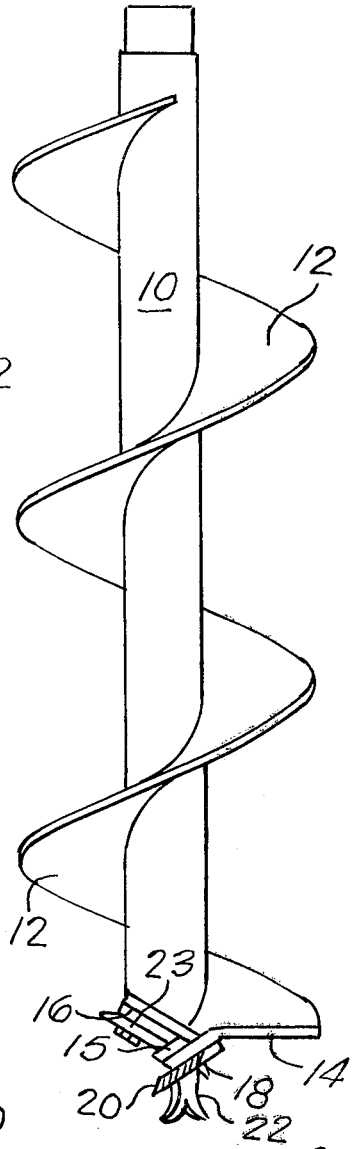
FIG. 3. FIG. 4.
FIG. 2.
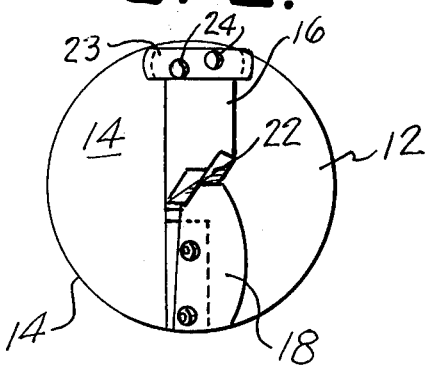

EARTH AUGER

BACKGROUND OF THE INVENTION

1. FIELD OF THE INVENTION

2. SUMMARY OF THE INVENTION

The present invention has for an object the provision of an improved earth auger adaptable to any earth drilling need, but more specifically for use in fencing and construction work where what is known as post hole augers are used.

Other objects and advantages will become apparent in the following specification when considered in light of the attached drawings.

BRIEF DESCRIPTION OF THE DRAWINGS

FIG. 1 is a side elevation of the device of the present invention;

FIG. 2 is a view looking upwardly at FIG. 1;

FIG. 3 is a front view of the device looking at the FIG. 1 view from the right; and FIG. 4 is a side elevation of the device looking at the FIG. 3 view from the right.

DESCRIPTION OF THE PREFERRED EMBODIMENT

A shaft 10 supports a single flight helical flight element 12. At the lower end of shaft 10 the helical element 12 terminates in a stabilizer plate 14 having an upwardly and rearwardly extending flange 16 that strengthens the stabilizer plate. The leading edge of the stabilizer plate 14 is deflected downwardly at 15. A one piece cutting bit and stabilizer pilot drill unit 18 comprising a blade edge 20 and a pilot 22 is secured to the leading edge of plate 14. Pilot 22 is illustrated as being of the "fishtail" type, but other shapes for this pilot drill may be used.

Blade 20 and pilot element 22 may be made integral by welding the two elements together, or may be forged or cast, as suits the convenience of the fabricator.

The leading sharpened edge of the blade 20 is swept rearwardly in a curve to form an increasing backward angle to present a slicing edge to the earth to be cut, extending from the piolt element 22 and therefore from the hole formed by pilot element 22 outwardly to the edge of stabilizing plate 14. This curve is especially helpful in severing tree roots that may be present in the earth.

It will be noted that the flange 16 extends more than half the diameter of the helical element. Flange 16 is shown as extending half the diameter of helical element 12 plus half the diameter of shaft 10 so that it is seen that the pilot 22, centered on the axis of shaft 10 is spaced downwardly from the bottom end of shaft 10 which terminates at plate 14 and flange 16. This is best illustrated in FIG. 3.

Penetration by the pilot element 22 necessarily displaces earth upwardly. In known augers great force is required to cause the pilot element to advance as the displaced earth from the pilot hole must be moved radially outwardly of the auger in order to be lifted by the cutting blade and helical element. In the present invention penetration by the pilot element requires only limited downward force regardless of the depth at which the auger is operating because the pilot element will be operating submerged in loose earth since the blade 18–20 lifts the earth from around pilot element 22 faster than pilot element 22 raises dirt from the pilot hole. Also the cutting edge 20 and its support 18 will operate more efficiently than the blades of known augers because all of the earth below stabilizer plate 14 will be loose dirt except at the very edge 20 of the blade. The blade 20, therefore, will more effectively "thread" its auger into the ground as the loose dirt under stabilizer plate 14 will not offer as much resistance to downward movement of the auger as the hard packed earth into which the auger is penetrating.

A tooth 23 having sharpened edges on its opposite ends is releasably secured to the flange 16 adjacent the outer edge thereof. The tooth 23 effectively balances the load factors during operation of the auger, it undercuts the outside corner of the main unitary bit and thereby protects the main bit from excess wear on the outer corner. The reversable sharpened edges of the tooth 23 reduces replacement costs of the tooth 23.

A lateral sweep of dirt particles or movement of dirt around the outer corner of the unitary blade causes proportionate greater wear at the outer corner of the unitary blade and pilot assembly. Also a useful vertical sweep of dirt particles is observed which is facilitated by the slicing, threading engagement of the blade into the earth.

This vertical sweep is useful in that it constitutes a self sharpening process by wearing away the beveled edge of the blade away from a hard surfacing band placed on the bottom side of the blade.

This sharpening process differs in my opionion to earth cutting blades now used as the sweep of loosened dirt sharpens the beveled area above the hard facing band rather than the presently used system of allowing the underneath side of the blade to wear away first.

Having thus described the preferred embodiment of the invention it should be understood that numerous structural modifications annd adaptations may be resorted to without departing from the spirit of the invention.

What is claimed is:

1. An earth auger comprising a shaft, a continuous flight element extending upwardly along and coaxial with said shaft, said flight element terminating at its lower extremity in a stabilizing plate whose upper portion has a flange which supports undercutting tooth element at the outer extend of said flange remote from said shaft, said stabilizing plate terminating at a position diametrically opposed from and lower than said tooth element having means thereon for fastening a stabilizer pilot drill means, said last named means comprising a continuous curved blade element of radial extent and a pilot drill disposed on the inner portion of said blade axially aligned with said shaft but remote therefrom to provide a space between said pilot drill and said shaft.

2. The auger of claim 1 wherein said tooth element is removeable.

3. The auger of claim 1 wherein said tooth element has two cutting elements which can be rotated.

* * * * *